US009373907B2

(12) United States Patent
Chiang et al.

(10) Patent No.: US 9,373,907 B2
(45) Date of Patent: Jun. 21, 2016

(54) FLEXIBLE FLAT CABLE, ELECTRICAL CONNECTOR, AND FLEXIBLE FLAT CABLE ASSEMBLY

(71) Applicant: Wistron Corporation, New Taipei (TW)

(72) Inventors: Yu-Feng Chiang, New Taipei (TW); Cheng-Hao Lee, New Taipei (TW); Tung-Huang Kuo, New Taipei (TW)

(73) Assignee: Winstron Corporation, Hsichih District (TW)

( * ) Notice: Subject to any disclaimer, the term of this patent is extended or adjusted under 35 U.S.C. 154(b) by 0 days.

(21) Appl. No.: 14/572,334

(22) Filed: Dec. 16, 2014

(65) Prior Publication Data

US 2015/0200473 A1 Jul. 16, 2015

(30) Foreign Application Priority Data

Jan. 15, 2014 (TW) ..... 103101458 A

(51) Int. Cl.
*H01R 12/00* (2006.01)
*H01R 12/79* (2011.01)
*H01R 12/77* (2011.01)

(52) U.S. Cl.
CPC ..... *H01R 12/79* (2013.01); *H01R 12/775* (2013.01)

(58) Field of Classification Search
CPC ..... H01R 9/0735; H01R 23/668
USPC ..... 439/67, 493, 495, 330, 77
See application file for complete search history.

(56) References Cited

U.S. PATENT DOCUMENTS

2002/0045381 A1* 4/2002 Ishii ..... H01R 12/79 439/495
2009/0120662 A1* 5/2009 Tanaka ..... H01R 12/592 174/113 R
2011/0036615 A1 2/2011 Noda et al.
2013/0040477 A1* 2/2013 Ashibu ..... H01R 12/88 439/153

FOREIGN PATENT DOCUMENTS

TW 200717335 A 5/2007
TW M354203 U 4/2009
TW 200919847 A 5/2009

OTHER PUBLICATIONS

The Office Action issued to Taiwanese Counterpart Application No. 103101458 by the Taiwan Intellectual Property Office on May 13, 2015 along with an English translation of sections boxed in red.

* cited by examiner

*Primary Examiner* — Phuongchi T Nguyen
(74) *Attorney, Agent, or Firm* — Brinks Gilson & Lione; John C. Bacoch

(57) ABSTRACT

A flexible flat cable includes conductive wires disposed on a first surface of an insulation layer, and a cover shield covering an opposite second surface and side surfaces of the insulation layer. An electrical connector includes an insulation case defining an insertion space for receiving an insertion portion of the flexible flat cable, conductive terminals disposed on the base and contacting respectively with the conductive wires, and a ground unit. The ground unit includes a contacting portion disposed in the insertion space and contacting with the cover shield of the flexible flat cable, and a conductive portion extending out of the insulation case for grounding the flexible flat cable.

14 Claims, 5 Drawing Sheets

FLEXIBLE FLAT CABLE, ELECTRICAL CONNECTOR, AND FLEXIBLE FLAT CABLE ASSEMBLY

CROSS-REFERENCE TO RELATED APPLICATION

This application claims priority of Taiwanese Application No. 103101458, filed on Jan. 15, 2014.

BACKGROUND OF THE INVENTION

1. Field of the Invention

The present invention relates to flexible flat cable assembly.

2. Description of the Related Art

Referring to FIG. 1, a conventional flexible flat cable 9 generally includes an insulation base layer 91 having two opposite surfaces, conductive wires (not shown) provided on one of the two surfaces of the insulation base layer 91, a shielding member 92 provided on the other one of the two surfaces of the insulation base layer 91, and an insulation outer layer (not shown) that covers partially the conductive wires and the shielding member 92 to expose two end parts of the conductive wires for electrical connection with two electrical connectors. In order to ground the flexible flat cable 9, a portion of the insulation outer layer covering the shielding member 92 should be partly removed to expose the shielding member 92 such that a conductive tape 901 may be attached to the exposed part of the shielding member 92 and to a metal component 902. The metal component 902 generally is a metal casing of an electronic device (not shown), in which the flexible flat cable 9 is disposed.

However, the conventional flexible flat cable 9 cannot be grounded if there is no metal component nearby. Moreover, the insulation outer layer should be removed before attachment of the conductive tape 901.

SUMMARY OF THE INVENTION

Therefore, an object of the present invention is to provide a flexible flat cable assembly that may alleviate the above drawbacks of the prior art.

Accordingly, a flexible flat cable assembly of the present invention includes a flexible cable and an electrical connector.

The flexible flat cable includes an insulation layer, a plurality of conductive wires, and a cover shield. The insulation layer extends in a longitudinal direction, and has a first surface, a second surface that is opposite to the first surface, a pair of side surfaces that extend in the longitudinal direction, and an end surface that interconnects the side surfaces and the first and second surfaces. The conductive wires are spaced apart from each other, are disposed on the first surface of the insulation layer, extend in the longitudinal direction, and are spaced apart from the side surfaces. The cover shield covers the second surface and the side surfaces of the insulation layer. The flexible flat cable has an insertion portion close to the end surface of the insulation layer.

The electrical connector includes an insulation case, a plurality of conductive terminals, and at least one ground unit. The insulation case has a base, and a pair of side walls that are connected to the base and that are spaced apart from and opposite to each other. The base cooperates with the side walls to define an insertion space for receiving the insertion portion of the flexible flat cable. The conductive terminals are disposed on the base and are spaced apart from each other. Each of the conductive terminals corresponds to and contacts with a respective one of the conductive wires so as to establish electrical connection therewith. The ground unit is disposed at the insulation case close to one of the side walls, and includes a contacting portion that is disposed in the insertion space and that contacts with the cover shield of the flexible flat cable, and a conductive portion that extends out of the insulation case and that is configured for grounding the flexible flat cable.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE EMBODIMENTS

Figure 1:
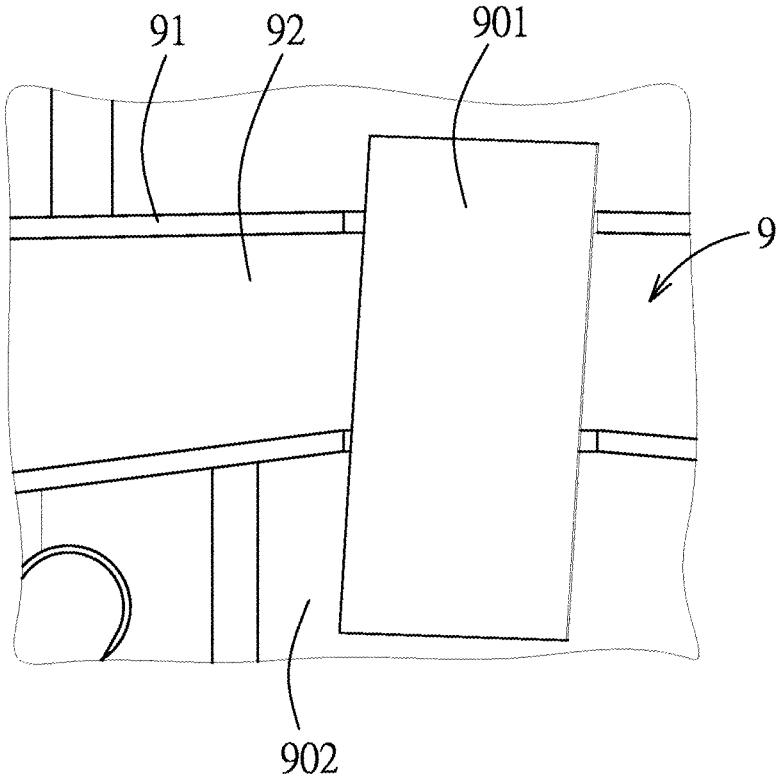
F I G. 1 PRIOR ART
FIG. 1 is a fragmentary schematic view of a conventional flexible flat cable.

Before the present invention is described in greater detail, it should be noted that like elements are denoted by the same reference numerals throughout the disclosure.

Figure 2:
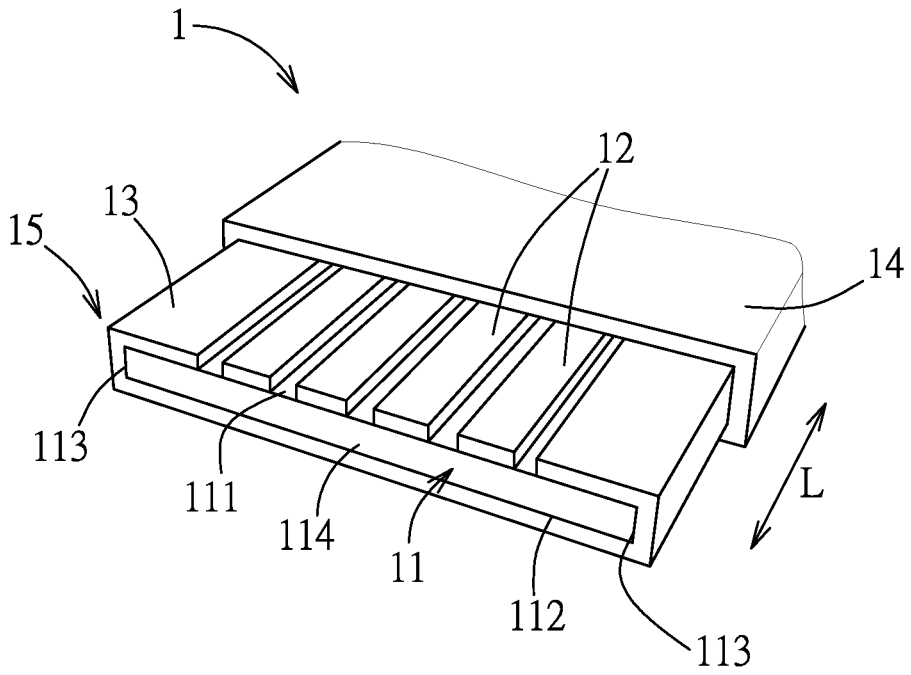
FIG. 2 is a fragmentary perspective view of a flexible flat cable of a flexible flat cable assembly according to a first embodiment of the present invention.
Figure 3:
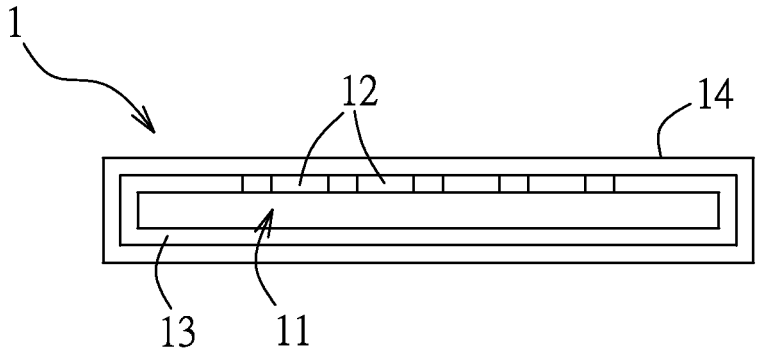
FIG. 3 is a front view of the flexible flat cable of the first embodiment.
Figure 4:
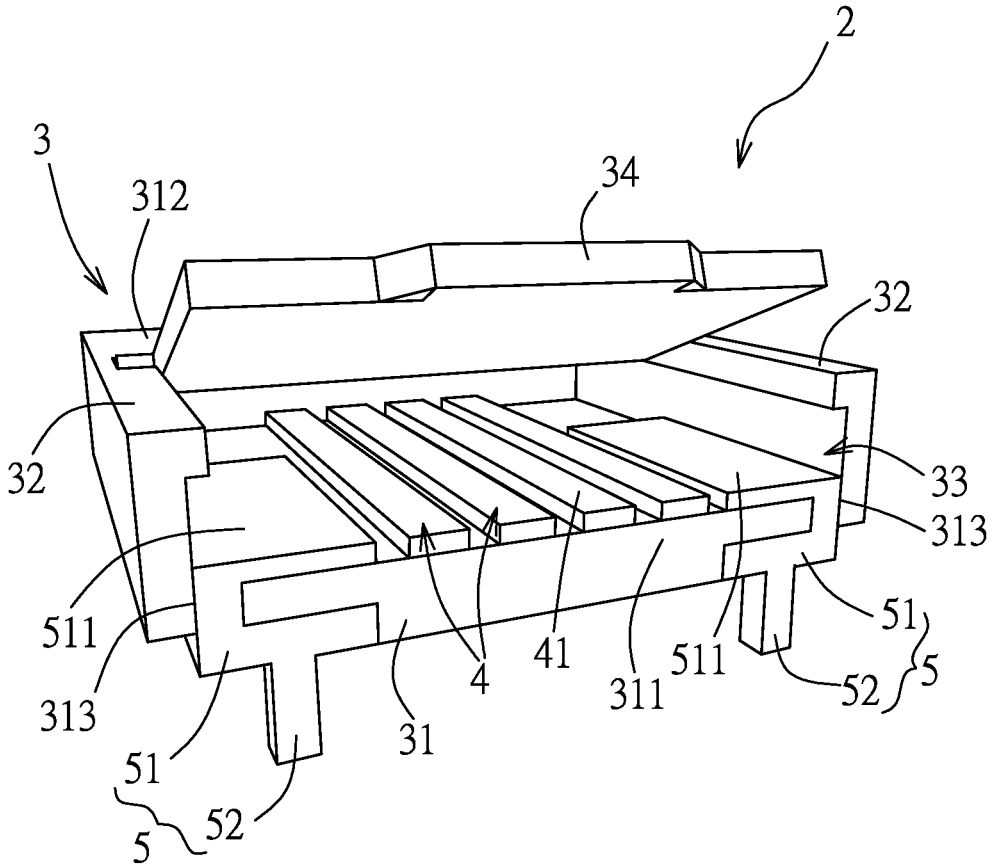
FIG. 4 is a perspective view of an electrical connector of the flexible flat cable assembly of the first embodiment.

Referring to FIGS. 2 to 4, a flexible flat cable assembly according to a first embodiment of the present invention is shown to include a flexible flat cable 1 and an electrical connector 2.

The flexible flat cable 1 includes an insulation layer 11, a plurality of conductive wires 12, a cover shield 13 and an insulation outer sheath 14. The insulation layer 11 extends in a longitudinal direction (L), and has a first surface 111, a second surface 112 that is opposite to the first surface 111, a pair of side surfaces 113 that extend in the longitudinal direction (L), and an end surface 114 that interconnects the side surfaces 113 and the first and second surfaces 111, 112. The conductive wires 12 are spaced apart from each other, are disposed on the first surface 111 of the insulation layer 11, extend in the longitudinal direction (L), and are spaced apart from the side surfaces 113. The cover shield 13 covers the second surface 112 and the side surfaces 113 of the insulation layer 11. Further, the cover shield 13 extends to the first surface 111 of the insulation layer 11 to cover a portion of the first surface 111, and is spaced apart from the conductive wires 12. That is to say, a portion of the cover shield 13 on the first surface 111 is arranged in the longitudinal direction (L) to be parallel to and flank the conductive wires 12. The insulation outer sheath 14 covers partially the conductive wires 12 and the cover shield 13 to expose parts of the conductive wires 12 and the cover shield 13 that are close to the end surface 114 of the insulation layer 11 and that cooperate to define an insertion portion 15 of the flexible flat cable 1. In other words, the insertion portion 15 is a portion of the flexible flat cable 1 that is not covered by the insulation outer sheath 14. In this embodiment, the portion of the cover shield 13 on the first surface ill is flush with the conductive wires 12 at the insertion portion 15. The flexible flat cable 1 may also have another insertion portion (not shown), substantially the same as the insertion portion 15, close to another end surface (not shown) of the insulation layer 11.

Figure 5:
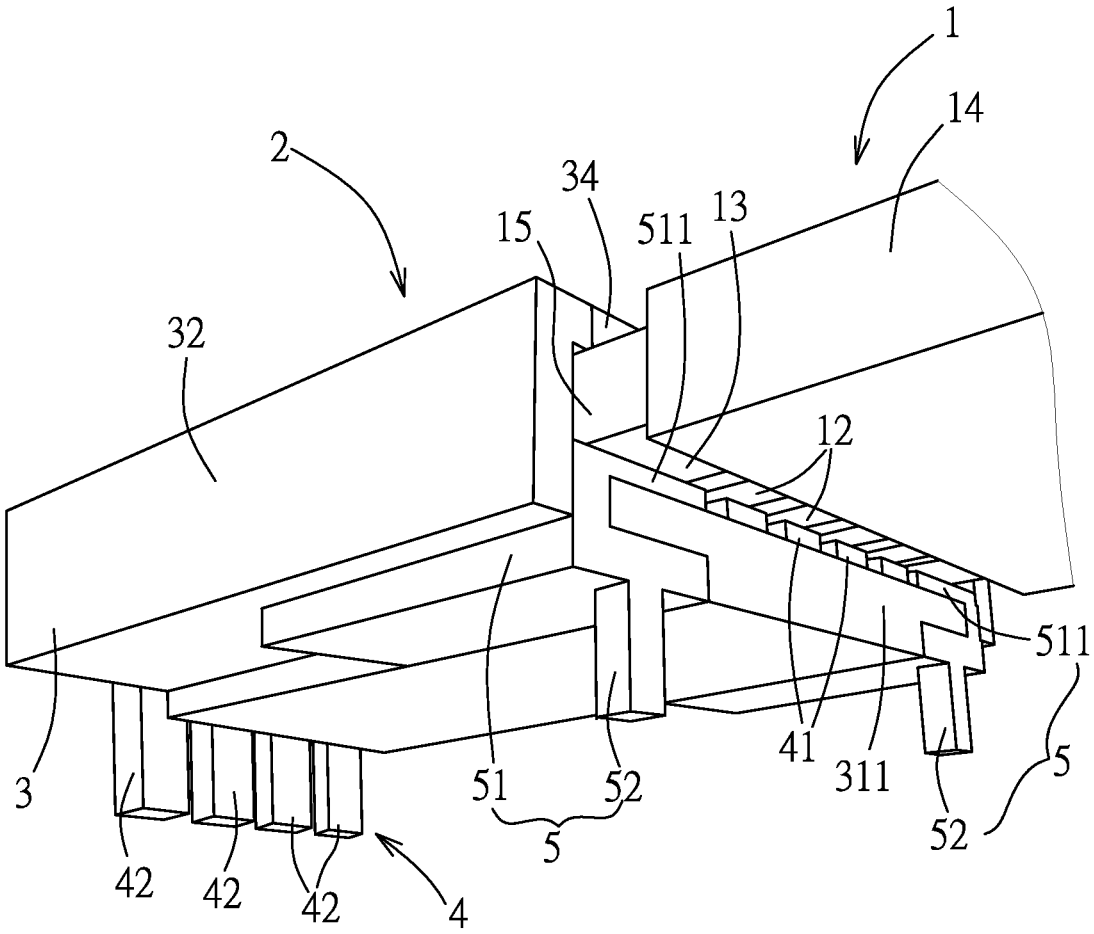
FIG. 5 is a fragmentary perspective of the flexible flat cable assembly of the first embodiment for illustrating an assembling relationship between the flexible flat cable and the electrical connector.

Referring to FIGS. 4 and 5, the electrical connector 2 includes an insulation case 3, a plurality of conductive terminals 4, and two ground units 5. The insulation case 3 has a base 31, and a pair of side walls 32 that are connected respectively to two opposite sides of the base 31 and that are spaced apart from and opposite to each other. The base 31 cooperates with the side walls 32 to define an insertion space 33 for receiving the insertion portion 15 of the flexible flat cable 1. The insulation case 3 further includes a securing board 34 for pressing against and securing the insertion portion 15. The base 31 includes a board portion 311 and a rear wall portion 312. Each of the conductive terminals 4 has a wire-contacting portion 41 that is disposed on the board portion 311, and a tail portion 42 that extends out of the rear wall portion 312. The wire-contacting portion 41 of each of the conductive terminals 4 contacts with a respective one of the conductive wires 12. The tail portions 42 are to be welded to and connected electrically to a circuit board (not shown).

The ground units 5 are disposed symmetrically at the insulation case 3 close to the side walls 32, respectively. Specifically, each of the ground units 5 includes a U-shaped main body 51 and a conductive portion 52. The U-shaped main body 51 has one segment, which is disposed in the insertion space 33, serving as a contacting portion 511. The conductive portion 52 extends from another segment of the U-shaped main body 51 opposite to the contacting portion 511 out of the insulation case 3, and is configured for welding to and connecting electrically to the circuit board. The board portion 311 of the insulation case 3 is formed with two grooves 313, each of which accommodates the U-shaped main body 51 of a respective one of the ground units 5. To be specific, the insulation case 3 and the ground units 5 are formed separately, and then, are assembled together. The insulation case 3 is made of a plastic material, and the ground units 5 are made of a metal material. In addition, the contacting portions 511 respectively of the ground units 5 are disposed on the board portion 311, and are spaced apart from and flank the wire-contacting portions 41 of the conductive terminals 4. Moreover, the contacting portions 511 of the ground units 5 are flush with the wire-contacting portions 41 of the conductive terminals 4. Therefore, since the portion of the cover shield 13 on the first surface 111, as mentioned above, is flush with the conductive wires 12 at the insertion portion 15, each of the conductive terminals 4 may correspond to and contact with a respective one of the conductive wires 12 when the insertion portion 15 of the flexible flat cable 1 is inserted into the insertion space 33 of the electrical connector 2. Meanwhile, the portion of the cover shield 13 that flanks the conductive wires 12 on the first surface 111 may contact with the contacting portions 511 of the ground units 5, thereby grounding the flexible flat cable 1 via the ground units 5 and the circuit board.

With such configuration, when the insertion portion 15 of the flexible flat cable 1 is connected electrically to the electrical connector 2, the cover shield 13 is meanwhile grounded by contacting with the ground units 5 such that additional grounding procedures (such as removal of an insulation outer layer and attachment of a conductive tape) are not required. Moreover, since the ground units 5 are grounded directly via the circuit board, the flexible flat cable 1 can be grounded even when there is no metal component nearby.

It is understood that the electrical connector 2 in this embodiment includes two ground units 5, but may include only one ground unit 5 in other embodiments of the present invention.

Figure 6:
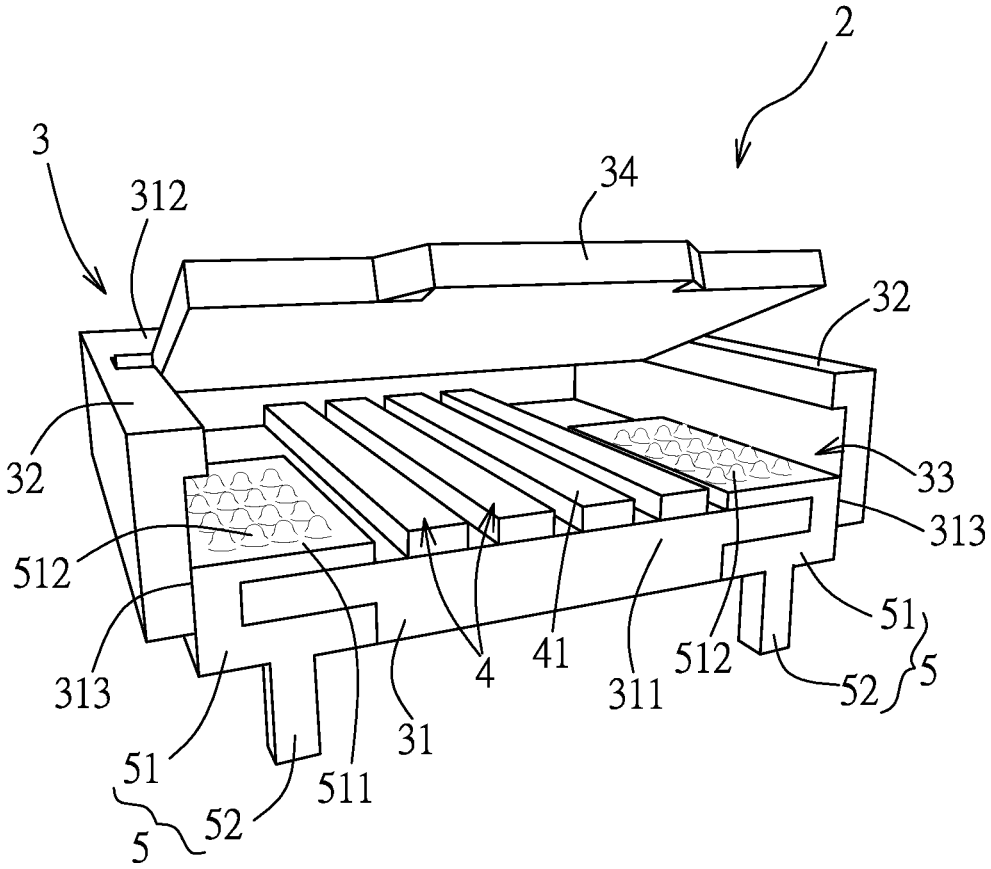
FIG. 6 is a perspective view of an electrical connector of the flexible flat cable assembly according to a second embodiment of the present invention.

Referring to FIG. 6, the flexible flat cable assembly according to a second embodiment of the present invention is shown to be similar to the first embodiment. The only difference resides in that each of the contacting portions 511 of the ground units 5 has a plurality of protrusions 512. Apexes of the protrusions 512 are flush with the wire-contacting portions 41 of the conductive terminals 4. The configuration of the protrusions 512 may facilitate contact with the cover shield 13 of the flexible flat cable 1, thereby ensuring grounding of the cover shield 13.

To conclude, when the insertion portion 15 of the flexible flat cable 1 is connected electrically to the electrical connector 2, the cover shield 13 is meanwhile grounded by contacting with the ground units 5 such that additional grounding procedures are not required. Moreover, since the ground units 5 are grounded directly via the circuit board, the flexible flat cable 1 can be grounded even when there is no metal component nearby.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A flexible flat cable assembly comprising:

a flexible flat cable including an insulation layer extending in a longitudinal direction, and having a first surface, a second surface that is opposite to said first surface, a pair of side surfaces that extend in the longitudinal direction, and an end surface that interconnects said side surfaces, a plurality of conductive wires spaced apart from each other, disposed on said first surface of said insulation layer, extending in the longitudinal direction, and spaced apart from said side surfaces, and a cover shield covering said second surface and said side surfaces of said insulation layer, said flexible flat cable having an insertion portion close to said end surface of said insulation layer; and an electrical connector including an insulation case having a base, and a pair of side walls that are connected to said base and that are spaced apart from each other, said base cooperating with said side walls to define an insertion space for receiving said insertion portion of said flexible flat cable, a plurality of conductive terminals disposed on said base and spaced apart from each other, said conductive terminals corresponding to, contacting with and establishing electrical connection with said conductive wires, respectively, and a ground unit disposed at said insulation case close to one of said side walls, and including a contacting portion that is disposed in said insertion space and that contacts with said cover shield of said flexible flat cable, and a conductive portion that extends out of said insulation case and that is configured for grounding said flexible flat cable.

2. The flexible flat cable assembly as claimed in claim 1, wherein said cover shield extends to and further covers a portion of said first surface, and is spaced apart from said conductive wires.

3. The flexible flat cable assembly as claimed in claim 2, wherein said flexible flat cable further includes an insulation outer sheath that covers partially said cover shield and said conductive wires to expose said insertion portion of said flexible flat cable.

4. The flexible flat cable assembly as claimed in claim 2, wherein said electrical connector includes two of said ground units that are disposed symmetrically at said insulation case close to said side walls, respectively.

5. The flexible flat cable assembly as claimed in claim 4, wherein said base includes a board portion, each of said conductive terminals having a wire-contacting portion that is disposed on said board portion and that contacts with a respective one of said conductive wires, said contacting portions respectively of said ground units being disposed on said board portion and being spaced apart from and flanking said wire-contacting portions of said conductive terminals.

6. The flexible flat cable assembly as claimed in claim 5, wherein a portion of said cover shield on said first surface is flush with said conductive wires at said insertion portion, and said contacting portions of said ground units are flush with said wire-contacting portions of said conductive terminals.

7. The flexible flat cable assembly as claimed in claim 6, wherein each of said contacting portions of said ground units has a plurality of protrusions, respective apexes of said protrusions being flush with said wire-contacting portions of said conductive terminals.

8. The flexible flat cable assembly as claimed in claim 6, wherein each of said ground units further includes a U-shaped main body, and said board portion is formed with two grooves, each of which accommodates said U-shaped main body of a respective one of said ground units, wherein one segment of said U-shaped main body that is disposed in said insertion space serves as said contacting portion, and said conductive portion extends from another segment of said U-shaped main body opposite to said contacting portion.

9. A flexible flat cable comprising:

an insulation layer extending in a longitudinal direction, and having a first surface, a second surface that is opposite to said first surface, a pair of side surfaces that extend in the longitudinal direction, and an end surface that interconnects said side surfaces and said first and second surfaces;

a plurality of conductive wires spaced apart from each other, disposed on said first surface of said insulation layer, extending in the longitudinal direction, and spaced apart from said side surfaces; and a cover shield covering said second surface and said side surfaces of said insulation layer, extending to and covering a portion of said first surface, and being spaced apart from said conductive wires, the cover shield being configured for grounding, said flexible flat cable having an insertion portion close to said end surface of said insulation layer.

10. The flexible flat cable as claimed in claim 9, further comprising an insulation outer sheath that covers partially said cover shield and said conductive wires to expose said insertion portion of said flexible flat cable.

11. An electrical connector for a flexible flat cable, comprising:

an insulation case having a base, and a pair of side walls that are connected to said base and that are spaced apart from and opposite to each other, said base cooperating with said side walls to define an insertion space for accommodating insertion of the flexible flat cable;

a plurality of conductive terminals disposed on said base and spaced apart from each other; and at least one ground unit disposed at said insulation case close to one of said side walls, and including a contacting portion that is a plate and that is disposed in said insertion space, and a conductive portion that extends out of said insulation case and that is configured for grounding the flexible flat cable.

12. The electrical connector as claimed in claim 11, wherein said electrical connector includes two of said ground units that are disposed symmetrically at said insulation case close to said side walls, respectively.

13. The electrical connector as claimed in claim 12, wherein said base includes a board portion, each of said conductive terminals having a wire-contacting portion that is disposed on said board portion, said contacting portions respectively of said ground units being disposed on said board portion and being spaced apart from and flanking said wire-contacting portions of said conductive terminals.

14. The electrical connector as claimed in claim 13, wherein each of said ground units further includes a U-shaped main body, and said board portion is formed with two grooves, each of which accommodates said U-shaped main body of a respective one of said ground units, wherein one segment of said U-shaped main body that is disposed in said insertion space serves as said contacting portion, and said conductive portion extends from another segment of said U-shaped main body opposite to said contacting portion.

* * * * *